US009394795B1

(12) United States Patent
Kimmel et al.

(10) Patent No.: US 9,394,795 B1
(45) Date of Patent: Jul. 19, 2016

(54) MULTIPLE PIECE TURBINE ROTOR BLADE

(75) Inventors: Keith D. Kimmel, Jupiter, FL (US); William L. Plank, Tequesta, FL (US)

(73) Assignee: J & S DESIGN LLC, Jupiter, FL (US)

( * ) Notice: Subject to any disclaimer, the term of this patent is extended or adjusted under 35 U.S.C. 154(b) by 672 days.

(21) Appl. No.: 12/706,241

(22) Filed: Feb. 16, 2010

(51) Int. Cl.
*F01D 5/14* (2006.01)
*F01D 5/30* (2006.01)

(52) U.S. Cl.
CPC ..... *F01D 5/147* (2013.01); *F01D 5/3007* (2013.01); *F05D 2240/30* (2013.01); *F05D 2240/307* (2013.01); *F05D 2300/13* (2013.01)

(58) Field of Classification Search
CPC ..... F01D 5/14; F01D 5/147; F01D 5/30; F01D 5/3007; F01D 5/303; F05D 2240/20; F05D 2240/24; F05D 2240/242; F05D 2240/30; F05D 2240/307
USPC ..... 416/193 A, 219 R, 220 R, 224, 225, 226, 416/228, 248
See application file for complete search history.

(56) References Cited

U.S. PATENT DOCUMENTS

| | | | | |
|---|---|---|---|---|
| 2,848,192 | A * | 8/1958 | Hayes | 416/90 R |
| 3,240,468 | A * | 3/1966 | Watts et al. | 415/117 |
| 4,473,336 | A * | 9/1984 | Coney et al. | 416/96 R |
| 5,030,063 | A * | 7/1991 | Berger | 416/220 R |
| 5,318,406 | A * | 6/1994 | Bardes | 416/223 A |
| 5,328,331 | A * | 7/1994 | Bunker et al. | 416/96 R |
| 5,720,431 | A * | 2/1998 | Sellers et al. | 416/97 R |
| 6,190,131 | B1 * | 2/2001 | Deallenbach | 416/144 |
| 6,499,943 | B1 * | 12/2002 | Beeck et al. | 415/115 |
| 7,670,116 | B1 * | 3/2010 | Wilson et al. | 416/226 |
| 7,758,314 | B2 * | 7/2010 | Wilson et al. | 416/226 |
| 7,967,565 | B1 * | 6/2011 | Kimmel et al. | 416/96 A |
| 8,033,790 | B2 * | 10/2011 | Vance | 416/97 R |
| 8,186,953 | B1 * | 5/2012 | Kimmel | 416/97 R |
| 8,251,658 | B1 * | 8/2012 | Diggs et al. | 416/62 |
| 8,511,999 | B1 * | 8/2013 | Kimmel | F01D 5/147 416/193 A |
| 8,678,764 | B1 * | 3/2014 | Kimmel | F01D 5/20 416/228 |
| 2006/0120869 | A1 * | 6/2006 | Wilson et al. | 416/97 R |
| 2009/0193657 | A1 * | 8/2009 | Wilson et al. | 29/889.721 |
| 2010/0080687 | A1 * | 4/2010 | Vance | 415/115 |
| 2011/0020137 | A1 * | 1/2011 | Wilson et al. | 416/97 R |

FOREIGN PATENT DOCUMENTS

| | | | | |
|---|---|---|---|---|
| DE | 10305912 | B4 * | 1/2014 | F01D 5/147 |
| GB | 1605191 | A * | 3/1983 | |

* cited by examiner

*Primary Examiner* — Igor Kershteyn
*Assistant Examiner* — Christopher R Legendre
(74) *Attorney, Agent, or Firm* — John Ryznic

(57) ABSTRACT

A spar and shell turbine rotor blade with a spar and a tip cap formed as a single piece, the spar includes a bottom end with dovetail or fir tree slots that engage with slots on a top end of a root section, and a platform includes an opening on a top surface for insertion of the spar in which a shell made from an exotic high temperature resistant material is secured between the tip cap and the platform. The spar is tapered to form thinner walls at the tip end to further reduce the weight and therefore a pulling force due to blade rotation. The spar and tip cap piece is made from a NiAL material to further reduce the weight and the pulling force.

5 Claims, 5 Drawing Sheets line B-B line A-A

MULTIPLE PIECE TURBINE ROTOR BLADE

GOVERNMENT LICENSE RIGHTS

This invention was made with Government support under contract number DE-FG02-07ER84668 awarded by Department of Energy. The Government has certain rights in the invention.

CROSS-REFERENCE TO RELATED APPLICATIONS

None.

BACKGROUND OF THE INVENTION

1. Field of the Invention

The present invention relates generally to gas turbine engine, and more specifically for a spar and shell turbine rotor blade.

2. Description of the Related Art Including Information Disclosed Under 37 CFR 1.97 and 1.98

A gas turbine engine, such as an industrial gas turbine (IGT) engine, a hot gas stream is passed through a turbine to produce mechanical energy. It is well known that the efficiency of the turbine, and therefore of the engine, can be increased by passing a higher temperature gas stream through the turbine. This is known as the turbine inlet temperature. The highest turbine inlet temperature is limited to the material properties of the turbine, especially the first stage stator vanes and rotor blades, since these airfoils are exposed to the highest temperature gas stream.

Higher turbine inlet temperatures can be obtained with a combination of improved material properties that will allow higher temperature and improved airfoil cooling. Prior art turbine rotor blades are made from nickel super alloys produced by the investment casting process. It has been proposed in the past to form the blades from high temperature resistant materials such as tungsten or molybdenum or columbium. These materials have melting temperature so high that they cannot be cast or machined using investment casting processes.

The applicant has proposed to form a turbine blade or stator vane from one of these exotic high temperature resistant materials in which the blade is formed with multiple pieces. One such embodiment is the spar and shell configuration in which a shell having an airfoil shape with a leading edge and a trailing edge, and a pressure side wall and a suction side wall, is formed from one of these exotic high temperature resistant materials using a wire EDM process for cutting the shell into its desired shape from a block of these materials. The shell is then secured to the spar and tip cap by clamping the shell between the tip cap and the platform of the blade. In order to use this spar and shell configuration, a separate tip cap from the spar is required. However, because the blade is a turbine rotor blade, the tip cap is exposed to high stress levels due to the centrifugal force developed from blade rotation. The tip cap must be capable of supporting the high centrifugal load from the shell as the blade rotates.

BRIEF SUMMARY OF THE INVENTION

A spar and shell turbine rotor blade with a single piece spar and tip cap, the spar having a bottom end that includes dovetail or fir tree slots that engage similar slots formed on a top end of a root section that has a fir tree configuration on the bottom end for insertion into a slot of a rotor disk. A shell is secured between the tip cap and a platform. Locating the dovetails or fir tree slots toward the bottom end of the spar allows for a larger surface area to receive the high stresses induced from the centrifugal forces acting against the tip cap and passing through the spar.

To reduce the pulling force (centrifugal loading) on the spar slots, the spar and tip cap piece can be formed from a NiAL (Nickel Aluminide) material that has ⅔ the density of nickel-based super-alloys. With a lower density, the pulling force due to the mass of the spar and tip cap will be less.

DETAILED DESCRIPTION OF THE INVENTION

A turbine rotor blade of the spar and shell construction in which a shell is made from a different material than the rest of the blade assembly. The shell is formed from an exotic high temperature resistant material, such as tungsten, molybdenum or columbium, which cannot be cast or machined using the investment casting process because these materials have very high melting temperatures. The spar 11 and the tip cap 12 can be formed from conventional materials such as nickel super alloys or NiAL (Nickel Aluminide) formed using the investment casting process with some machining after the casting process. In order to form a shell from one of these exotic high temperature resistant materials, the wire EDM (electric discharge machining) process is used to cut the shell from a single block of this material.

Figure 1:
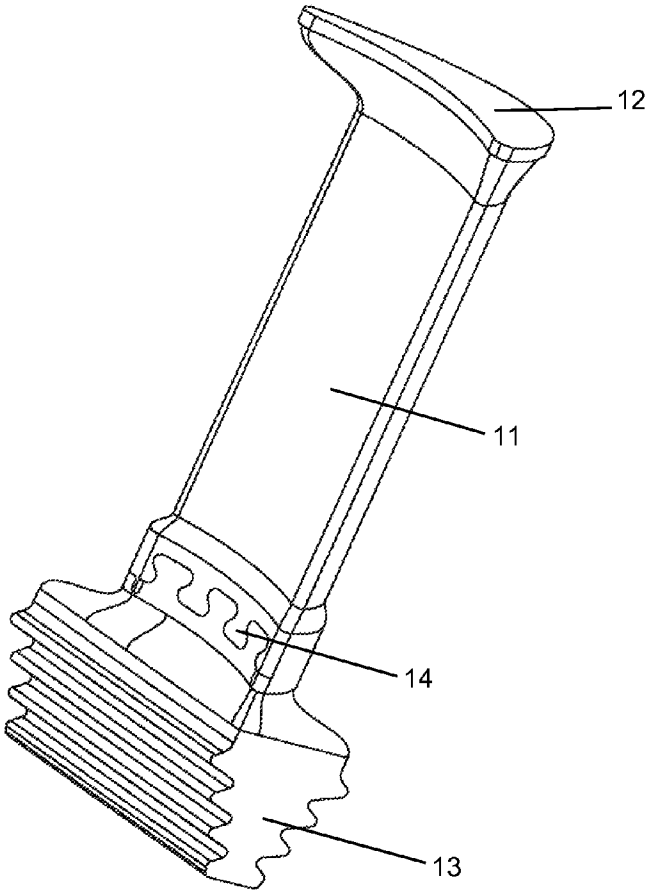
FIG. 1 shows a schematic view of a single piece spar and tip cap secured to a root section for the spar and shell blade of the present invention.

FIG. 1 shows a spar 11 with an integral tip cap 12 to form a single piece spar and tip cap for the spar and shell turbine rotor blade 10 of the present invention. Forming the tip cap 12 and the spar 11 as a single piece offers several advantages that are described below in a spar and shell blade. In previous embodiment of a spar and shell rotor blade, the tip cap was a separate piece from the spar and required a dovetail or fir tree configuration to secure the tip cap to the spar against radial displacement. Because of the high pulling force developed from holding the shell in place, the stress levels on the dovetail or fir tree slots is very high and above the maximum acceptable stress level. Locating the dovetail or fir tree slots 14 on the bottom end of the spar overcomes this disadvantage. The surface area for the slots at the tip end of the spar 11 is much smaller than at the platform end. Thus, the slots 14 can be made larger and therefore more evenly spread out the load and reduce the high concentration stress loads that would occur. As seen in FIG. 1, a root section of the blade assembly includes a similar dovetail or fir tree configuration of slots 16 that engage with the slots 14 of the spar. The root section 13 also includes a conventional fir tree configuration on the lower end that will engage with a slot formed within a rotor disk.

Another embodiment of the present invention is to form the spar 11 and tip cap 12 piece from NiAL (Nickel Aluminide) instead of the nickel based super-alloys because the NiAL material has ⅔ of the density of the Nickel based super-alloys but with similar strength and creep resistance. Thus, the pulling force that occurs on the slots 14 is reduced even more.

Figure 2:
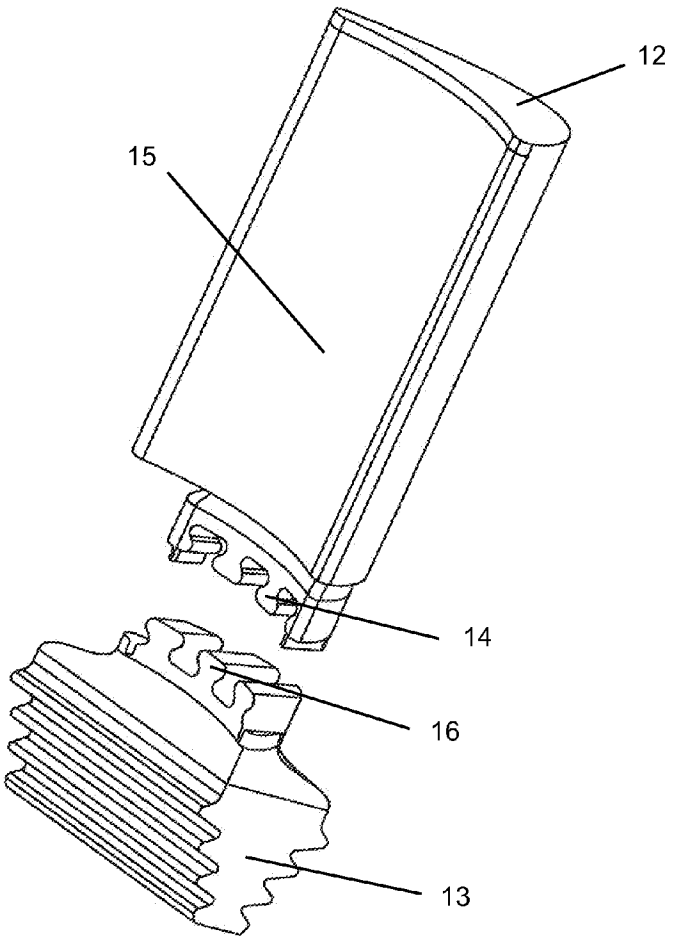
FIG. 2 shows a schematic view of the spar and tip cap with a shell detached from the root section of the blade assembly of the present invention.
Figure 3:
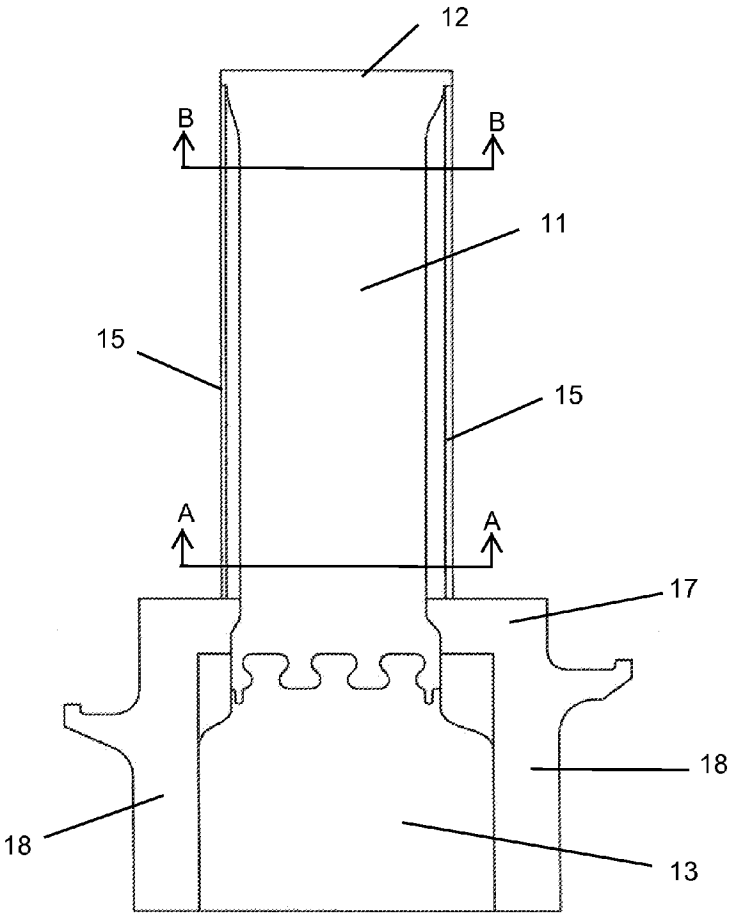
FIG. 3 shows a cross sectional side view of an assembled spar and shell blade of the present invention.
Figure 4:
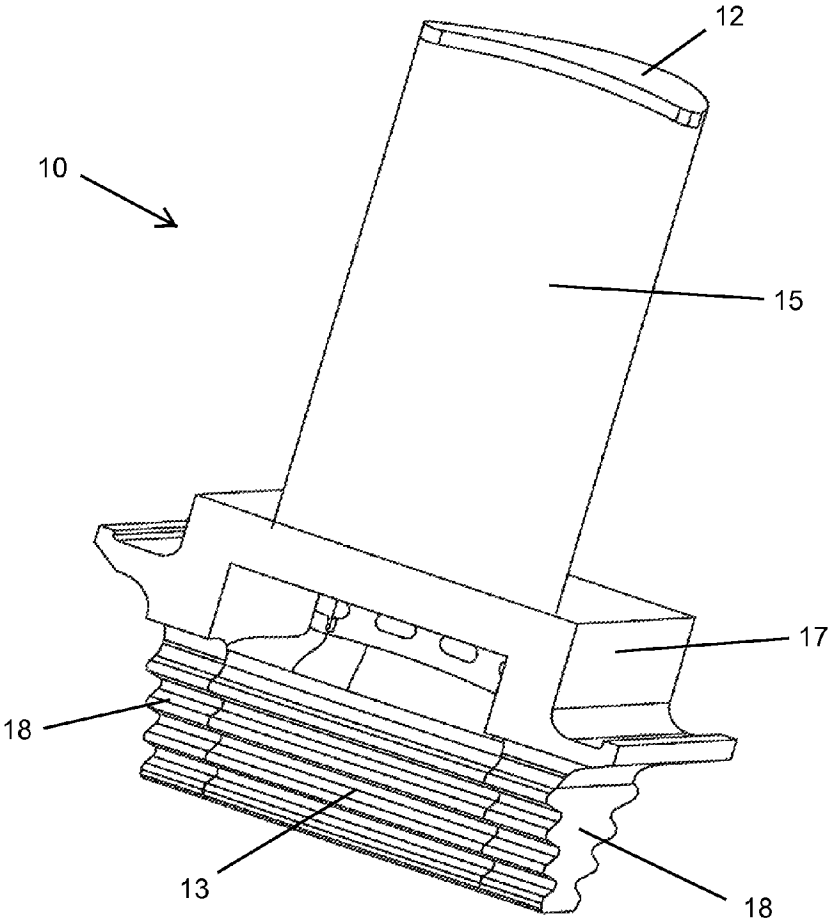
FIG. 4 shows a schematic view of the assembled spar and shell blade of the present invention.

FIG. 2 shows a shell 15 placed over the spar 11 and tip cap 12 piece that is detached from the root section 13 and showing the slots 16 for engaging the spar 11 to the root 13. FIG. 3 shows an assembled spar and shell blade assembly 10 of the present invention with the shell 15 secured in place between the tip cap 12 and a surface of a platform 17 that also forms part of the blade assembly 10. The platform 17 includes two legs 18 that also have a fir tree configuration of similar size and shape as the fir tree on the root 13. With the blade assembled as seen in FIG. 3, the fir trees on the platform legs 18 and the root 13 will slide into the rotor disk slot to secure the blade assembly together.

Figure 6:
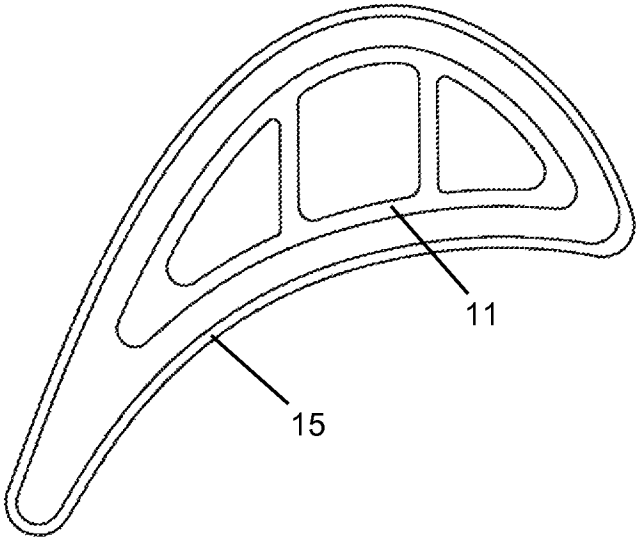
FIG. 6 shows a cross sectional view of the spar and shell through line B-B in FIG. 3 at an upper end of the spar.
Figure 5:
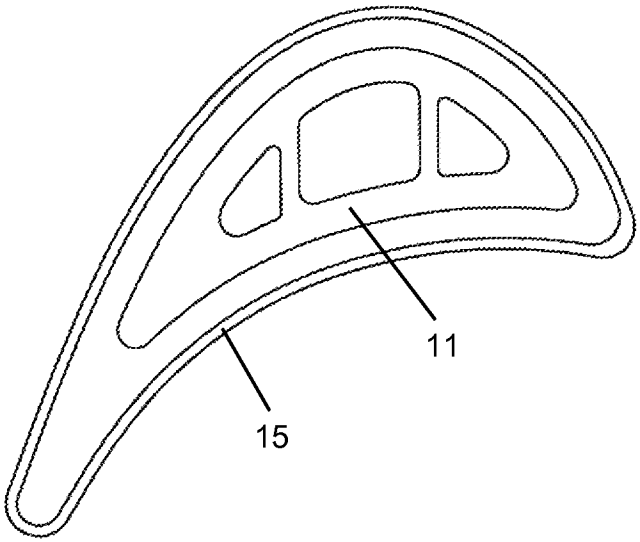
FIG. 5 shows a cross sectional view of the spar and shell through line A-A in FIG. 3 at a lower end of the spar.

Because the slots 14 are located on the bottom end of the spar 11 instead at the tip end, another feature of the present invention is that the spar 11 can be tapered toward the tip to further reduce the weight of the spar which further reduces the pulling force of the spar and tip cap on the slots 14. FIGS. 5 and 6 show cross section views of the spar 11 from near the bottom end (FIG. 5) and near the tip end (FIG. 6). The FIG. 5 cross section shows the spar 11 with thicker walls than in the FIG. 6 cross section. The walls taper from thicker walls in the bottom end of the spar to thinner walls in the tip end to reduce the weight. The spar 11 also includes ribs extending across the walls from a pressure side to a suction side to reinforce the spar 11. One or more ribs can be used.

The single piece spar 11 and tip cap 12 and the root 13 can be made from the same material so that thermal stress loads are minimized between these parts. The platform can also be made from the same material as well. The shell 15 is cut from an exotic high temperature resistant material such as tungsten, molybdenum or columbium (these materials cannot be cast or machined) using the wire EDM process in which the outer airfoil surface is cut and then the inner airfoil surface is cut to form a single piece airfoil or shell. Tungsten is a relatively heavy material compared to the molybdenum and columbium materials, and therefore is not very good as a material for a shell in a rotor blade because of the rotational effects. Tungsten is best used as a shell material for a stator vane because of the lack of rotation. In another embodiment, the shell can be formed from two pieces and then bonded together to form a single piece shell 15.

The platform 17 includes an opening on the top surface in which the lower end of the spar 11 is inserted so that the slots 14 can be inserted into the slots 16 of the root 13. To assemble the blade assembly 10, the spar 11 and tip cap 12 are inserted into the shell 15, and then the spar is inserted into the opening in the platform 17. The root 13 is then inserted into the slots 14 of the spar 11 so that the dovetails or fir trees in the platform legs 18 and the root 13 are aligned. Then, the assembled blade 10 is inserted into the slot of the rotor disk.

We claim:

1. A multiple piece turbine rotor blade comprising:

a single piece spar and tip cap;

a dovetail or fir tree configuration on a bottom end of the spar;

a root having a top end with a dovetail or fir tree configuration to engage the spar to prevent radial displacement of the spar with respect to the root;

the root having a fir tree configuration on the bottom end for engagement with a slot formed within a rotor disk;

a platform with an opening to receive the spar;

the platform having two legs each with a similar shaped fir tree of the root; and, a shell secured between the tip cap and the platform.

2. The multiple piece turbine rotor blade of claim 1, and further comprising:

the spar is tapered such that walls of the spar are thinner at the tip end than at the platform end.

3. The multiple piece turbine rotor blade of claim 1, and further comprising:

the shell is a single piece shell formed from an exotic high temperature resistant material that cannot be cast or machined.

4. The multiple piece turbine rotor blade of claim 1, and further comprising:

the spar and tip cap are formed from a Nickel Aluminide material.

5. The multiple piece turbine rotor blade of claim 1, and further comprising:

the spar includes a rib extending from a pressure side to a suction side of the spar.

* * * * *